United States Patent [19]

Keirle et al.

[11] 4,154,574

[45] May 15, 1979

[54] APPARATUS FOR TREATING WORKPIECES IN A BED OF PARTICLES

[75] Inventors: Trevor J. Keirle, Walsall; Robert L. Chester, Sandwell, both of England

[73] Assignee: Stone-Platt Fluidfire Limited, West Midlands, England

[21] Appl. No.: 765,207

[22] Filed: Feb. 3, 1977

[30] Foreign Application Priority Data

Feb. 3, 1976 [GB] United Kingdom ..... 4139/76

[51] Int. Cl.[2] ..... F27B 15/00

[52] U.S. Cl. ..... 432/58; 432/107; 34/128; 266/172; 266/173; 209/296

[58] Field of Search ..... 432/14, 15, 58, 103, 432/105, 107, 108, 109, 111, 112, 114; 34/57 R, 110, 128, 130; 209/285, 293, 296, 297, 492; 198/676; 214/21; 266/172, 173, 145

[56] References Cited

U.S. PATENT DOCUMENTS

| | | | |
|---|---|---|---|
| 865,110 | 9/1907 | Knapp | 34/128 |
| 1,533,997 | 4/1925 | Stinson | 209/296 |
| 1,869,705 | 8/1932 | Miscampbell | 432/95 |
| 2,039,645 | 5/1936 | Hechenbleikner | 266/173 |
| 3,300,199 | 1/1967 | Andersen | 266/173 |
| 3,635,456 | 1/1972 | Anthes et al. | 266/197 |
| 3,776,533 | 12/1973 | Vlnaty | 266/172 |

*Primary Examiner*—Henry C. Yuen

*Attorney, Agent, or Firm*—Spencer & Kaye

[57] ABSTRACT

Apparatus for treating workpieces in a bed of particles, e.g. for heat treating workpieces in a fluidize bed, comprises a chamber which contains the bed, a conveyor for conveying workpieces through the chamber into contact with particles of the bed within the chamber, and transporting means for transporting back to the bed particles which fall from the conveyor or workpieces after the conveyor and workpieces have advanced from the bed. The conveyor may comprise a rotatable open work drum, having an internal helical formation for advancing workpieces through it and an external helical formation of opposite hand to that of the internal helical formation to constitute the transporting means.

8 Claims, 2 Drawing Figures

APPARATUS FOR TREATING WORKPIECES IN A BED OF PARTICLES

FIELD OF THE INVENTION

This invention relates to apparatus for treating workpieces in a bed of particles and comprising a chamber for containing the bed and a conveyor for conveying work-pieces through the chamber and into contact with particles of the bed within the chamber. Such apparatus is hereinafter referred to as being of the kind specified.

SUMMARY OF THE INVENTION

According to the invention there is provided apparatus of the kind specified wherein there is adjacent to a workpiece-exit from the chamber transporting means for transporting back to the bed particles which fall from the conveyor, and/or from workpieces carried thereon, after the conveyor and workpieces have advanced from the bed.

The conveyor is preferably of open-work form such that particles of the bed can fall through the conveyor or is otherwise adapted to fail to carry particles of the bed. A conveyor of this preferred form can be so arranged that it comes into contact with the particles of the bed when the apparatus is in use, without substantial quantities of the particles being carried away from the chamber so that the bed is depleted and further parts of the apparatus are contaminated by particles. The conveyor may become partly submerged in the bed of particles during use.

The conveyor may discharge the workpieces into a quenching bath or some other part of the apparatus from which the particles are required to be excluded.

The conveyor may comprise a rotatable drum of openwork form, having an internal helical formation to advance workpieces through the drum when the latter is rotated, and the transporting means may comprise an external helical formation on the drum, the external formation having a lead which is of opposite hand to that of the internal helical formation.

The external helical formation is preferably a multi-start formation. This arrangement is one way in which the transporting means may be adapted to transport particles in a direction from the workpiece-exit from the chamber towards the bed at a rate which exceeds the rate at which particles can be advanced in the opposite direction by the conveyor.

The bed of particles is preferably fluidised when the apparatus is in use, a lower wall portion of the chamber being adapted to admit fluidising gas to the bed.

BRIEF DESCRIPTION OF DRAWINGS

The invention will now be described by way of example with reference to the accompanying drawings, wherein.

DESCRIPTION OF PREFERRED EMBODIMENT

Figure 1:
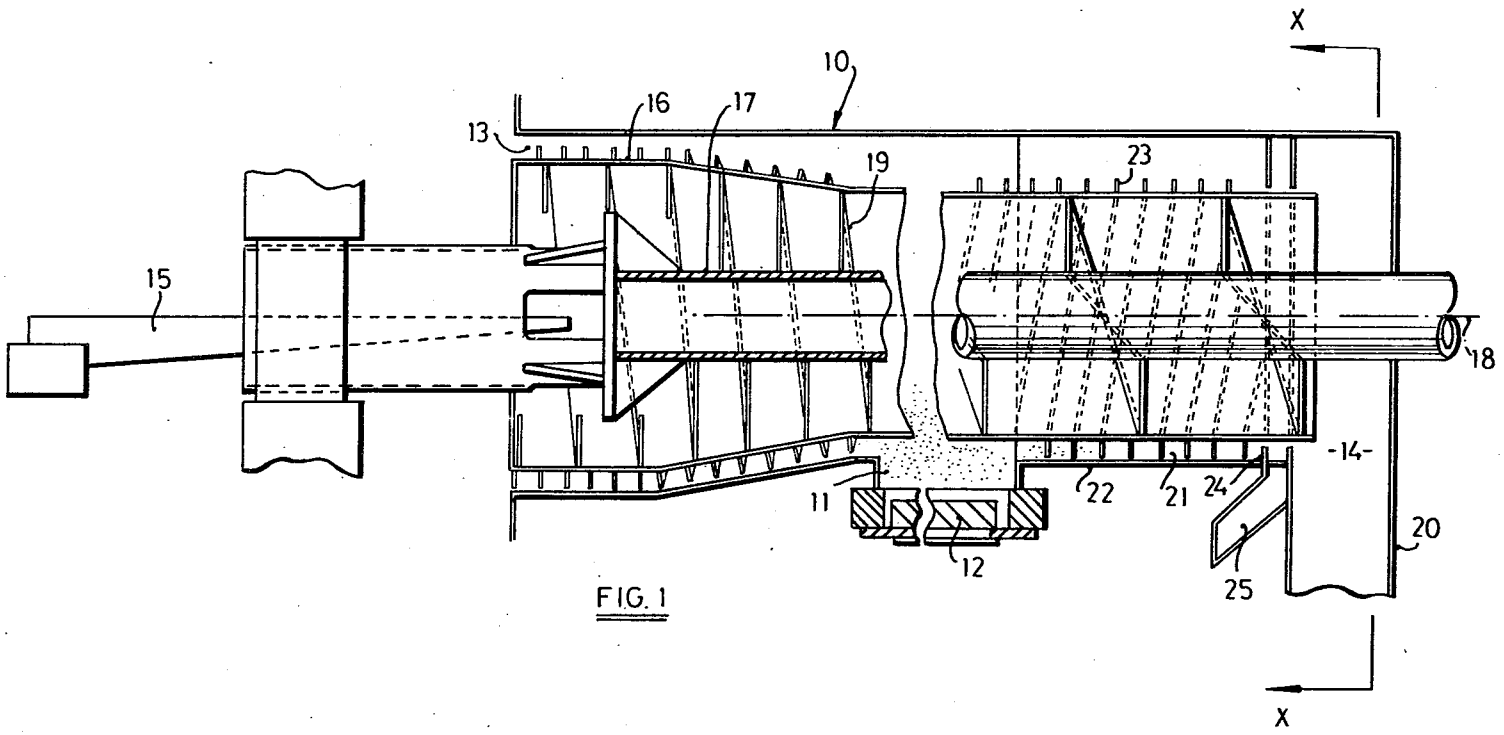
FIG. 1 shows a longitudinal cross-section through apparatus in accordance with the invention.

The apparatus comprises a chamber 10 which contains a bed 11 of particles, for example of alumina or silica sand. The bed is supported on a lower wall 12 of the chamber, which lower wall is adapted to admit gases to the bed so that the latter can be fluidised. In the particular example shown, the lower wall 12 is formed of a number of horizontal, porous tiles of ceramic material. The apparatus may be used to heat workpieces, in which case a hot gas may be fed through the wall 12 into the bed to fluidise the latter. Alternatively, the bed may be fluidised by a mixture of a gaseous fuel and air which are burned in the bed. The top of the chamber 10 is normally enclosed by a hood (not shown).

The apparatus further comprises a conveyor for conveying workpieces through the chamber 10 from an entrance 13 to an exit 14 thereof. The conveyor comprises a vibratory feeder 15 which extends into the chamber through the entrance and a drum 16 which is mounted by a shaft 17 for rotation about a horizontal axis 18 which extends longitudinally of the chamber. The drum 16 is open at both ends and one of these ends is disposed adjacent to the entrance 13 to the chamber so that workpieces can be delivered by the feeder 15 into the drum. Within the drum there is provided a helical flight 19 which, when the drum is rotated in use, advances workpieces along the drum in a direction from the entrance 13 to the exit 14. The exit may lead into a vertical chute 20 which communicates at its lower end with a quenching bath so that workpieces which are discharged from the drum 16 fall into the quenching bath (not shown). The pitch of the helical flight 19 is greater adjacent the exit of the drum that it is at the entrance and central region of the drum adjacent the bed 11.

When the bed 11 is fluidised, it has a depth such that a lower part of the drum 16 is submerged in the bed. Typically, the surface of the bed is spaced below the shaft 17 at the centre of the drum. The peripheral wall of the drum is of openwork form so that it can support workpieces which are to be treated in the bed but is not able to carry substantial quantities of the particles. The peripheral wall of he drum may be formed of a wire mesh or of perforate sheet material, for example sheet material formed with holes of $\frac{1}{4}$ inch diameter at a pitch of $\frac{3}{8}$ inch. Suitable drive means (not shown) is provided for driving the shaft 17 and drum 16 at a speed such that workpieces delivered into the drum will remain in the fluidised bed for the required treatment time.

Figure 2:
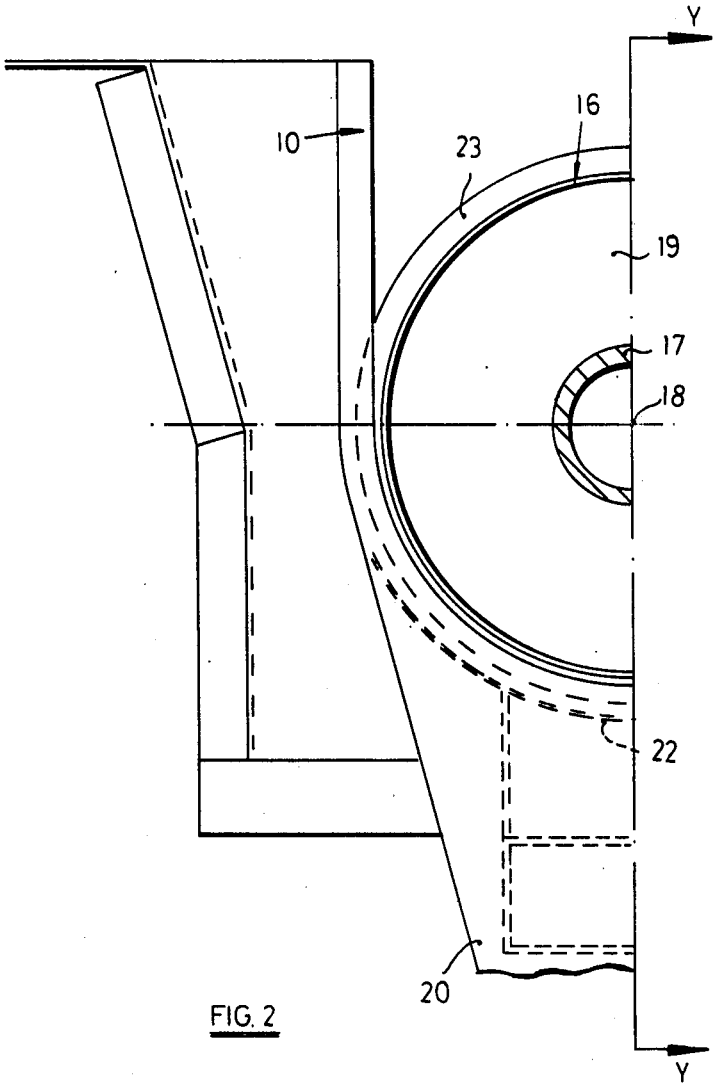
FIG. 2 shows a half-section on the line X—X of FIG. 1.

The internal flight 19 tends to advance the particles of the fluidised bed in a direction towards the exit 14. The workpieces which advance in this direction also tend to carry particles from the bed towards the exit. These particles will tend to fall through the peripheral wall of that part of the drum 16 which lies between the bed 11 and the exit 14. It will be seen that there is gap 21 between the bottom of the drum and a wall portion 22 of the chamber which lies below the drum and between the bed 11 and the exit 14. As shown in FIG. 2, the wall portion 22 is of part-cylindrical form so that it is spaced uniformly from the drum. Particles which are carried from the bed fall into the gap 21 and it is necessary to prevent such a quantity of particles accumulating in this gap that particles overflow through the exit from the chamber 10. To this end, there is provided transporting means for transporting particles from the gap 21 back to the bed 11.

The transporting means comprises a plurality of helical formations 23 which are attached on the outside of the drum 16 to rotate therewith. The lead of the formations 23 is of opposite hand to that of the internal flight 19, so that the formations 23 tends to feed particles along the gap 21 in a direction towards the bed 11. Since there are a plurality of helical formations 23, the transporting means is capable of feedng particles towards the bed at a faster rate than particles are advanced in a direction from the bed towards the exit. This is so, even in the illustrated case where the pitch of the internal flight 19 is greater in that part of the drum which lies between the bed 11 and the exit 14 than it is in the part of the drum which contacts the fluidised bed during operation. Such a variation in the pitch of the flight 19 may be made to convey workpieces from the bed to the exit more quickly than they are conveyed through the bed.

To further reduce the risk of particles which have been carried away from the bed by the drum 16 and workpieces therein escaping from the chamber 10 there is provided in the gap 21 at a position near to the exit 14 a barrier 24 which extends vertically from the wall portion 22 to a position close to the periphery of the drum. This barrier partly closes the gap 21. At the side of the barrier remote from the bed 11, there is provided a receiver 25 for receiving any particles which may overflow from the gap 21. This receiver may be in the form of a hopper from which particles are occasionally returned to the bed. Alternatively, means may be provided for returning particles automatically and either intermittently or continuously from the receiver to the bed.

We claim:

1. Apparatus for treating workpieces in a bed of particles, comprising a chamber for containing the bed of particles and having an entrance and an exit for the workpieces, conveyor means extending through the chamber for conveying workpieces through the chamber into contact with particles of the bed within the chamber, and transporting means located adjacent to said conveyor means within the chamber for transporting back to the bed particles falling from said conveyor means after passing the bed, wherein said conveyor means and said transporting means are constituted by an integral structure.

2. Apparatus for treating workpieces in a bed of particles, the apparatus including:

(a) a chamber for containing the bed of particles (b) conveyor means for conveying workpieces through the chamber into contact with particles of the bed within the chamber and to an exit of the chamber, (c) transporting means adjacent to the exit for transporting back to the bed particles falling from the conveyor means at a position spaced from the bed in a direction in which the workpieces are convyed from the bed, wherein the conveyor means comprises (d) an openwork drum (e) means mounting the drum for rotation about a longitudinal axis thereof, and (f) a helical formation provided internally of the drum for advancing workpieces longitudinally of the drum when the latter is rotated.

3. Apparatus according to claim 2 wherein the transporting means comprises a helical formation on the exterior of the drum, the external formation being of opposite hand to the internal helical formation.

4. Apparatus according to claim 3 wherein the transporting means comprises a plurality of helical formations on the exterior of the drum.

5. Apparatus according to claim 2 wherein the pitch of the internal helical formation is greater adjacent the workpiece exit than it is in a central region of the drum which contacts the bed of particles.

6. Apparatus according to claim 2 wherein the chamber comprises a part cylindrical wall uniformly spaced from the drum.

7. Apparatus for treating workpieces in a bed of particles, the apparatus comprising:

(a) a chamber for containing the bed of particles, the chamber having an exit for the workpieces, (b) conveyor means for conveying workpieces through the chamber into contact with particles of the bed within the chamber (c) a wall spaced below a part of the conveyor means adjacent to the workpiece exit to define a gap between said wall and said part of the conveyor means, (d) transporting means adjacent to the exit for transporting back to the bed particles falling from the conveyor means at a position spaced from the bed in a direction in which the workpieces are conveyed from the bed, the transporting means being arranged to engage particles in said gap and (e) barrier means extending from the wall towards the conveyor means for partially closing the gap.

8. Apparatus according to claim 7 further comprising, at a side of the barrier means remote from the bed, receiver means for receiving particles which overflow the barrier from the gap.

* * * * *